US006523895B1

(12) United States Patent
Vogtherr

(10) Patent No.: US 6,523,895 B1
(45) Date of Patent: Feb. 25, 2003

(54) ERGONOMIC CHAIR

(75) Inventor: Burkhard Vogtherr, Kandern-Holzen (DE)

(73) Assignee: Davis Furniture Industries, Inc., High Point, NC (US)

( * ) Notice: Subject to any disclaimer, the term of this patent is extended or adjusted under 35 U.S.C. 154(b) by 21 days.

(21) Appl. No.: 09/592,745

(22) Filed: Jun. 13, 2000

Related U.S. Application Data

(63) Continuation-in-part of application No. 09/245,470, filed on Feb. 5, 1999, now abandoned.

(51) Int. Cl.[7] ..... A47C 3/00
(52) U.S. Cl. ..... 297/300.1; 297/291
(58) Field of Search ..... 297/300.1, 353, 297/354.11, 354.12, 440.2, 445, 452.1, 452.18, 313, 314, 325, 326, 299, 301.1

(56) References Cited

U.S. PATENT DOCUMENTS

| | | | | |
|---|---|---|---|---|
| 826,575 A | | 7/1906 | Hunter | |
| 1,437,848 A | | 12/1922 | Kisor et al. | |
| 2,579,918 A | | 12/1951 | Freeman | 155/158 |
| 2,649,136 A | | 8/1953 | Eames | 155/54 |
| 2,662,586 A | | 12/1953 | Cramer | 155/164 |
| 2,796,920 A | | 6/1957 | Cowles | 155/156 |
| 3,133,763 A | * | 5/1964 | Stoll et al. | 297/300.1 X |
| 3,602,537 A | | 8/1971 | Kerstholt et al. | 297/304 |
| 3,726,560 A | | 4/1973 | Page | 297/349 |
| 3,934,930 A | | 1/1976 | Sandham | 297/291 |
| 4,099,774 A | * | 7/1978 | Sandham | 297/440.2 X |
| 4,489,203 A | | 12/1984 | van Zee et al. | 297/316 |
| 4,521,053 A | | 6/1985 | de Boer | 297/312 |
| 4,633,546 A | | 1/1987 | Bergs | 16/277 |
| 4,765,684 A | | 8/1988 | Kvalheim et al. | 297/429 |
| 5,080,318 A | | 1/1992 | Takamatsu et al. | 248/598 |
| 5,333,368 A | | 8/1994 | Kriener et al. | 297/301 |
| 5,486,056 A | * | 1/1996 | Thorn | 297/354.12 X |
| 5,551,754 A | * | 9/1996 | Neumueller | 297/353 |
| 5,649,740 A | | 7/1997 | Hodgdon | 297/303.1 |
| 5,683,142 A | | 11/1997 | Gunderson et al. | 297/440.21 |
| 5,711,576 A | * | 1/1998 | Olson et al. | 297/353 |
| 5,769,492 A | | 6/1998 | Jensen | 297/314 |
| 5,904,397 A | | 5/1999 | Fismen | 297/291 |
| 6,116,687 A | * | 9/2000 | Vogtherr | 297/300.1 |
| 6,305,747 B1 | * | 10/2001 | Mei | 297/440.2 X |

FOREIGN PATENT DOCUMENTS

| | | |
|---|---|---|
| CH | 681772 | 5/1993 |
| DE | 825147 | 7/1949 |
| GB | 623225 | 5/1949 |
| GB | 1583872 | 4/1981 |

* cited by examiner

*Primary Examiner*—Peter M. Cuomo
*Assistant Examiner*—Stephen Vu
(74) *Attorney, Agent, or Firm*—Womble Carlyle Sandridge & Rice, PLLC

(57) ABSTRACT

A chair of the type having a seat and a separate seat back including a chair frame with a rear segment. The seat back is movably secured to the frame by a mounting mechanism whereby the seat back is capable of pivoting about at least two axes of rotation. The seat may also be connected to a fixed seat support by at least one mounting mechanism, allowing the seat to be pivoted about at least one axis of rotation.

22 Claims, 10 Drawing Sheets

ERGONOMIC CHAIR

RELATED APPLICATIONS

This application is a continuation-in-part of U.S. application Ser. No. 09/245,470, filed on Feb. 5, 1999, now abandoned.

FIELD OF THE INVENTION

The present invention relates to the field of chairs, and, more particularly to chairs having seats and seat backs mounted on chair frames so as to provide controlled pivotal movement about a plurality of axes.

BACKGROUND OF THE INVENTION

Over the years, many designs have been developed for chairs, and particularly office chairs, with the goal of providing for some movement of the chair in response to the movement of the person sitting in the chair. This objective has been accomplished to a limited extent through designs that provide for unitary movement of the chair back and chair seat, or by designs allowing the chair back to move without relationship to and independently of the chair seat. However, these designs have either incorporated a fixed relationship between the movement of the seat and seat back, or have been designed so that the seat and seat back can move freely, but without consideration of seat and seat back response to the occupant of the chair. A number of mechanisms have been developed to permit chair back movement about one or two axes of rotation, but these approaches have not provided optimum comfort to and control by the occupant of the chair.

The development of tiltable chair seat backs has also seen some use of resilient, rubber-like mounting pads for attaching a chair seat back or cushion to a chair frame although these approaches have been somewhat successful, they have not permitted or provided for controlled movement about at least two axes of rotation, and thus, have not provided a satisfactory level of comfort.

SUMMARY OF THE INVENTION

The present invention is directed to a simple, improved office or work space chair having a separate seat and seat back mounted on a frame, thus permitting pivotal movement of the seat, seat back, or both, in response to the movement and physical characteristics of the occupant of the chair. A further object of the present invention is to provide a chair that is ergonomically enhanced, whereby the user is the synchronous factor in determining the relative positions of the seat and seat back.

Accordingly, one aspect of the present invention is to provide a chair of the type having a separate seat and seat back, that includes a chair frame having a rear segment and a mounting mechanism connecting the seat back to the rear segment. The mounting mechanism connects the seat back to the segment of the frame in such a manner as to permit controlled pivotal movement of the seat back about at least two, and preferably three or more axes of rotation. The construction of the mounting mechanism is simple, requiring relatively few parts, without the need for post-installation adjustment or maintenance. In the preferred embodiment, a generally circular-shaped resilient pad, such as natural rubber, is positioned between two plates to form the mounting mechanism; however, any suitable elastomer providing the required degree of Shore hardness may be used. The resilient pad should have a Shore hardness of between 45 and 100, but desirably between 80 and 90 and preferably about 85 to provide for maximum responsiveness to and control by the user. The size and thickness of the resilient pad may also be varied to provide either a lesser or greater degree of controlled movement. Desiritbly, the plates are embedded in the resilient pad such that the outside surfaces of the plates are substantially coplanar with corresponding outside edges of the resilient pad. The resilient pad provides limited torsional resistance to relative rotation between the two plates. The selection of the size, shape, and hardness of the resilient pad in combination with the ergonomic placement of the mounting mechanism, cause the seat back to "follow" the seat occupant thereby ensuring continuous, even support to the occupant's back.

Openings and slots are formed in and through the mounting mechanism for attaching the mounting mechanism to the rear segment of the frame and to the seat back In a preferred embodiment, the mounting mechanism further includes a slot extending inwardly from a peripheral edge of the mount. This preferred embodiment may further include a travel stop positioned in the slot and attached to the frame or to the seat back. The travel stop has a smaller sized or diameter portion positioned in the slot and a larger sized or diameter portion positioned in a cavity in the seat back or frame. The larger sized portion of the travel stop) limits the travel of the adjacent plate as the seat back is tilted backward or forward, and thus limits the travel of the seat back.

Another aspect of the present invention is to provide the chair described above whereby the seat back may be installed in two different configurations, depending on the desires of the occupant, Specifically, the chair has an approximately shoulder high seat back; however, the seat back can be optionally installed such that the high back portion is turned downward so that the chair will have a lower mid-height seat back. Thus, the resiliently mounted seat back of the chair offers a wide range of comfortable motion for the chair occupant.

A further aspect of the present invention is to provide a chair that further includes at least one, and desirably two, mounting mechanisms connecting the seat to the substantially fixed seat support, permitting movement of the seat in forward and rearward directions and limited movement from side to side For simplicity and economy, the mounting mechanisms are the same as those used to connect the seat back to the rear segment of the chair frame; however, a higher or lower Shore hardness for the resilient pad may be selected, depending upon the specific application and desires of the user. Likewise, the size of the resilient pads may be varied, or a single larger resilient pad may be used. A single resilient pad could be circular or oval to more closely conform to the width of the chair As with the mounting mechanism connecting the frame to the seat back, the thickness of the mounting mechanism can be varied to provide a greater or lesser degree of controlled movement. This selection and placement of the mounting mechanisms causes the seat to respond to and move with the occupant, thereby evenly distributing pressure on the occupant's hips, buttocks, and thighs.

The present invention, with independent mounting mechanisms connecting the respective seat and seat back portions of the chair to the frame of the chair, provides a construction having three variables: position of the seat back, position of the seat, and the user's body. Accordingly, because the mounting mechanisms are ergonomically located with respect to the seat and seat back and respond to and move with the individual occupant, the occupant's body (size, weight, height, and center of gravity) is the synchronous variable that determines the other two, thereby maximizing the occupant's comfort by evenly supporting the occupant's body.

These and other aspects of the present invention will become apparent to those skilled in the art after a reading of the following description of the preferred embodiments when considered in conjunction with the drawings.

DESCRIPTION OF THE PREFERRED EMBODIMENTS

Figure 1:
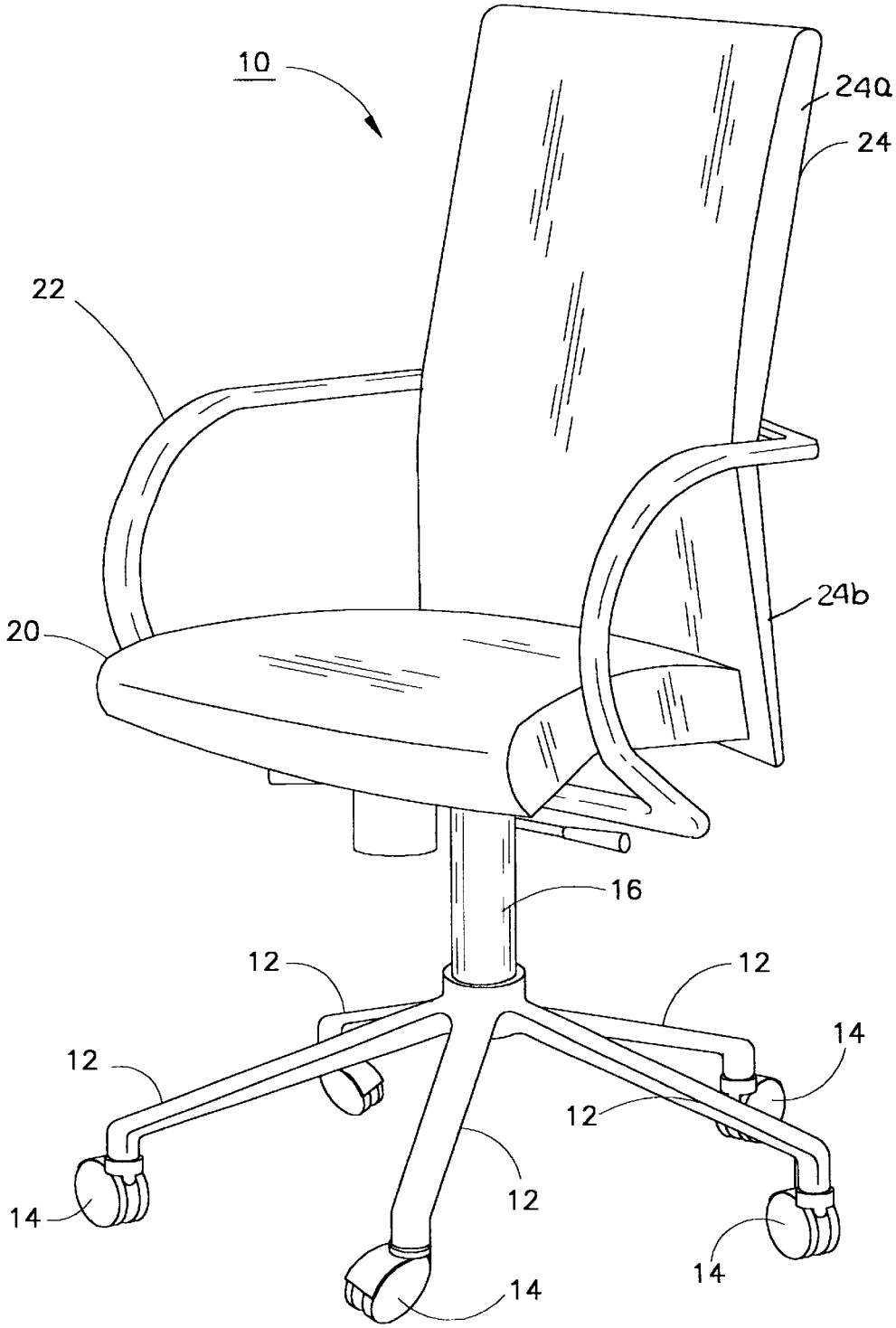
FIG. 1 is a front perspective view of a chair constructed according to the present invention.
Figure 1A:
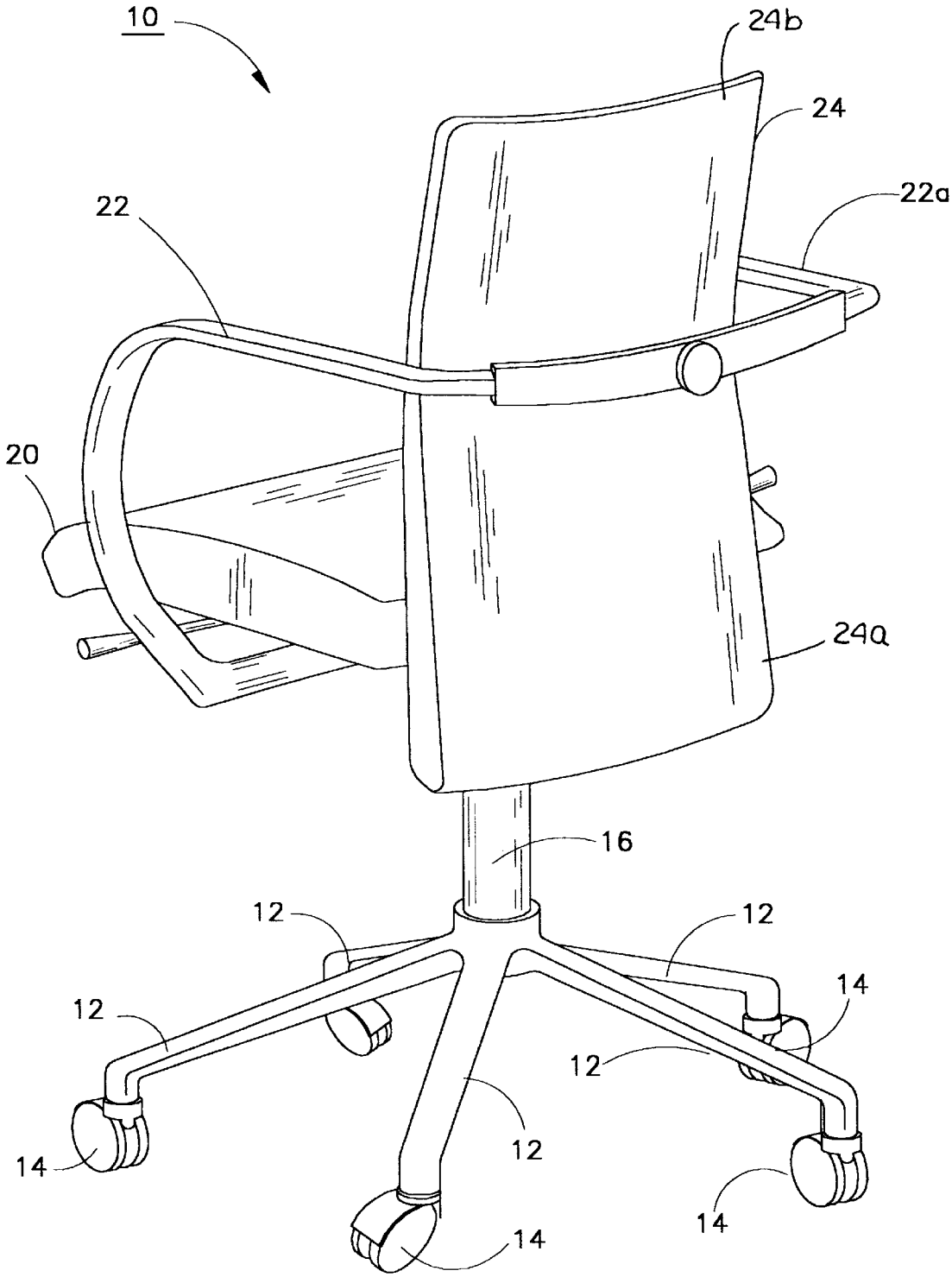
FIG. 1A is a rear perspective view of the chair of FIG. 1 with the seat back installed downward.

Referring now to the drawings in general and FIG. 1 in particular, it will be understood that the illustrations are for the purpose of describing a preferred embodiment of the invention and are not intended to limit the invention thereto. As best seen in FIGS. 1 and 1A, a chair constructed according to the present invention, generally designated 10, includes a plurality of legs 12 to which may be attached casters 14 for rollable movement. Alternatively, chair 10 could have conventional upright legs, a Same, a pedestal support, or other suitable supports known in the art Upright seat support column 16 extends upwardly from the junction point of legs 12 and is connected to the chair seat assembly 20. In this embodiment, a frame 22 is formed from one or more portions of a rigid support material and is attached at one end to one side of seat assembly 20 and at the other end to the opposing side of seat assembly 20. Alternatively, frame 22 may be pivotally attached to seat assembly 20, thus allowing a wider range of possible seat back 24 positions. Frame 22 includes a rear segment 22*a* that wraps around behind the chair seat back 24. It will be readily appreciated that in alternative embodiments, separate arm rests could be provided and secured to either side of seat assembly 20 with a single upright support frame extending upwardly from the rear of seat assembly 20 as is well known in the art This arrangement also constitutes a "rear segment" for the practice of the present invention. In either embodiment, a chair frame segment 22*a* will be provided adjacent the seat back 24.

To accommodate the desires and physical characteristics of individual users, seat back 24 may be installed in two different configurations. As shown in FIG. 1, chair 10 has a seat back 24 having a tall, or shoulder high, portion 24*a* and a short portion 24*b*. Alternatively, and as shown in FIG. 1A, seat back 24 is installed such that the tall portion 24*a* is turned downward and the short, mid-height, portion 24*b* is installed upward. This offers a wide range of comfortable motion for the chair occupant while providing aesthetically-pleasing options for the appearance of the chair.

Figure 4:
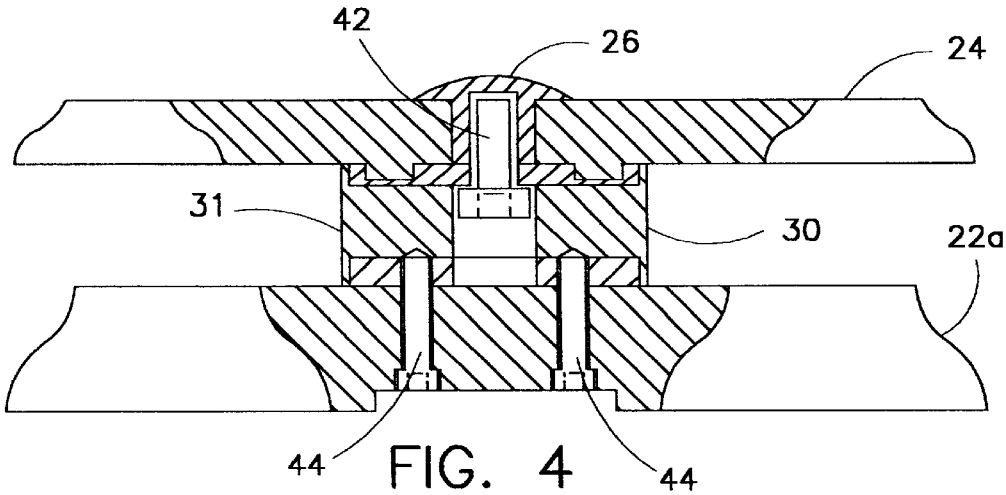
FIG. 4 is a sectional view taken through the point of attachment of the chair seat back to an adjacent chair frame member.
Figure 5:
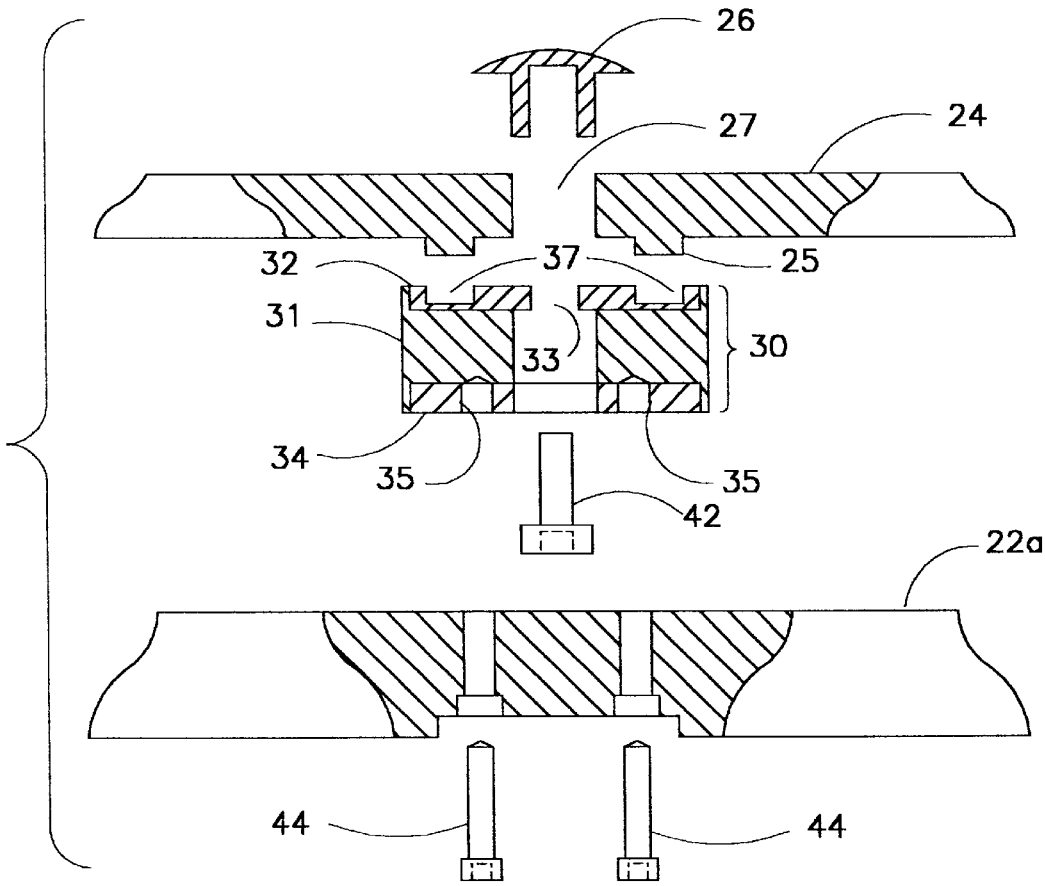
FIG. 5 is an exploded view of the attachment shown in FIG. 4.

In the preferred embodiment, the chair seat back 24 is movably secured to rear segment 22*a* by a single mounting mechanism 30. FIGS. 4 and 5 illustrate the preferred embodiment of the mounting arrangement. Seat back 24 includes an opening 27 through which is inserted a knob 26 that is threaded on its inner circumference. Desirably, the threaded knob has a smooth surface so as not to cause discomfort for the user of the chain. Alternatively, if seat back 24 is upholstered, then shown in FIGS. 4 and 5.

Figure 3A:
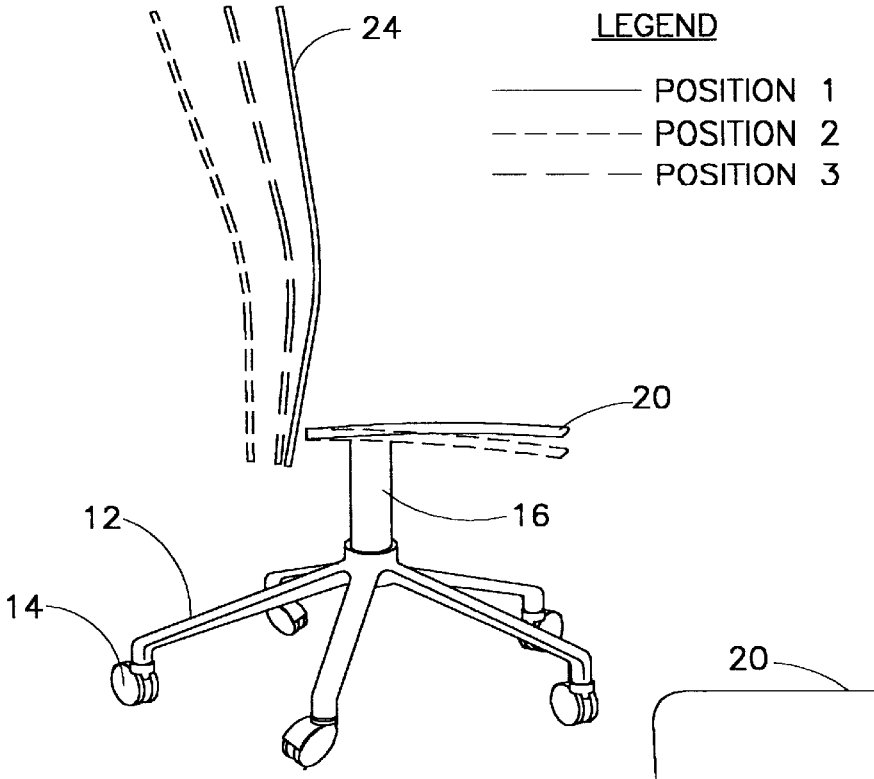
FIG. 3A is a schematic illustrating relative movement of the seat back and seat in the rearward and forward directions.
Figure 3B:
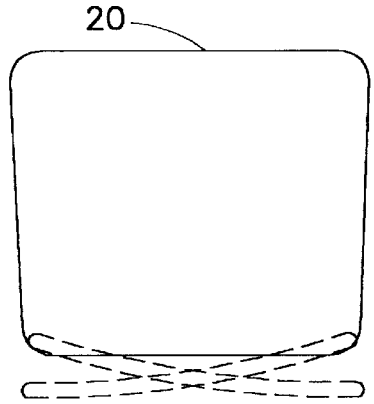
FIG. 3B is a schematic illustrating relative movement of the seat back about the mounting mechanism.
Figure 3C:
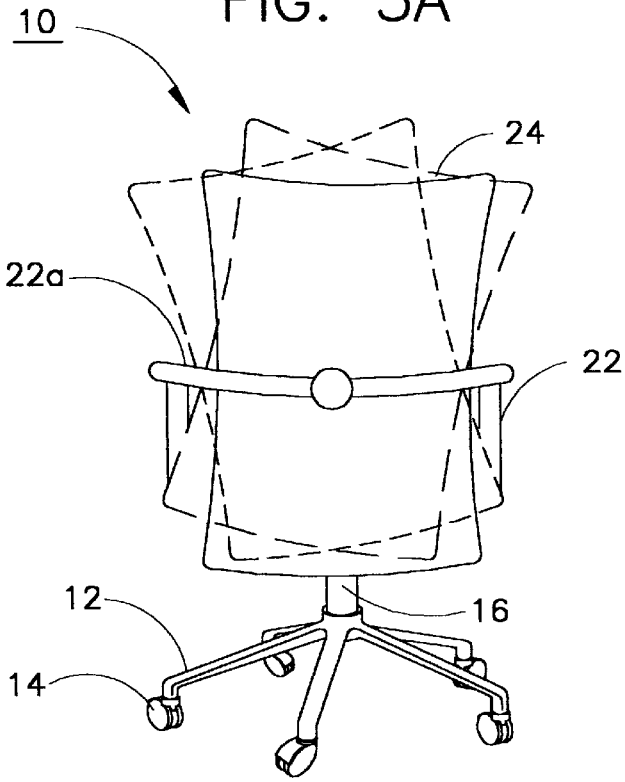
FIG. 3C is a schematic illustrating movement of the scat back about the seat back mounting mechanism.

The mounting mechanism 30 includes first and second plates 32, 34 and a resilient pad 31 positioned between and secured to the first and second plates. Plates 32, 34 are substantially parallel and laterally spaced apart from each other by resilient pad 31. Plates 32, 24 are preferably constructed from metal but could be constructed from any suitable material that has the physical properties to withstand the stresses generated during use of the chair. These materials include, but are not limited to thermoplastic, thermoset, and composite materials. In a preferred embodiment the plates 32, 34 are secured to the resilient pad 31 by being embedded therein such that the outer surfaces of the plates 32, 34 are substantially coplanar with the outer surfaces of the resilient pad 31. The parallel relationship between the plates changes as a person sitting in their chair moves about. For example, if the person moves so as to tilt the top of the seat back 24 forward, the first plate 32 will be tilted correspondingly with the seat back. The second plate 34 will tend to hold its position so that the plates form a "V." It will be appreciated that movement of the plates will be dampened by the resilient pad 31, the lower portion of which will be compressed. Similarly, the positioning of the plates will be reversed if the seat back is tilted backward. Accordingly, the construction and placement of mounting mechanism 30 causes seat back 24 to respond to and move with the occupant, thereby evenly supporting the occupant's back. FIGS. 3A through 3C illustrate the range of positions that seat back 24 may take in response to the occupant of the chair.

The seat back 24 may further include at least one nipple 25 extending from the seat back towards the mounting mechanism 30. The nipple 25 engages a corresponding recess 37 formed in the first plate 32 of the mounting mechanism 30. Although the present invention will function with one nipple 25 provided on seat back 24, desirably, two nipples 25 are provided. Each of the nipples 25 engages corresponding recesses 37 in the mounting mechanism 30. This arrangement prevents the seat back 24 from rotating independently from the mounting mechanism 30 as the seat back 24 moves from side to side and helps to ensure a secure connection between the seat back 24 and the mounting mechanism 30. As seat back 24 rotates from side to side, the first plate 32 should move with the seat back so as to create a torsional flexing of the resilient pad 31 it will be readily appreciated that without the nipples 25, there is an increased chance that the seat back 24 would rotate independently of the mounting mechanism 30. In that instance there would be less holding force exerted on the seat back by the mounting mechanism 30. It should be understood that, while the present invention will function properly without the nipples 25 in seat back and recesses 37 in the resilient mount, having these elements enhances the function of the present invention. It should be further understood that other approaches, such as the use of additional fasteners will ensure that the movement of the first plate 32 follows that of the seat back 24. Mounting mechanism 30 is secured to seat back 24 by a fastener 42, preferably a bolt, that extends through passage 33 to engage knob 26.

Once mounting mechanism 30 is secured to seat back 24, chair rear frame segment 22*a* is rigidly attached to second plate 34 using threaded fasteners 44 that extend through rear frame segment 22*a* to engage threaded openings 35 in second plate 34.

Figure 6:
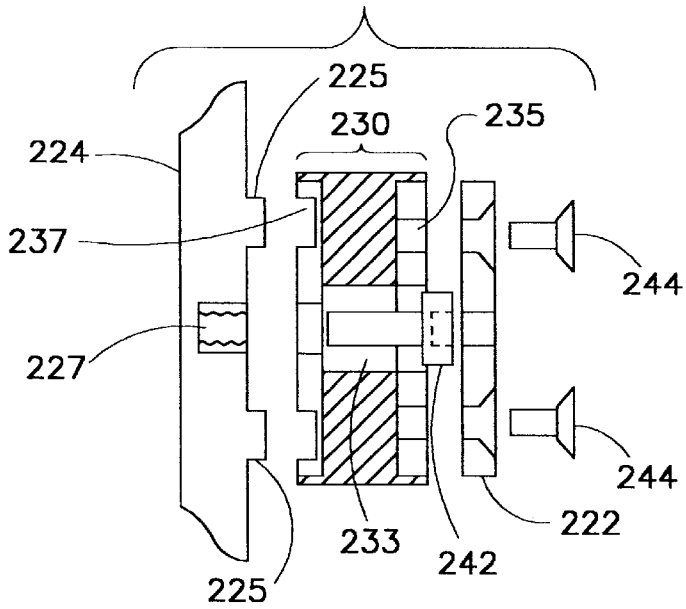
FIG. 6 is an exploded view showing an alternative embodiment of the present invention.

Turning now to FIG. 6, an alternative installation includes a seat back 224 having a threaded socket 227. The mounting mechanism 230 is secured to seat back 224 using fastener 242 which extends through a passage 233 in mounting mechanism 230. Nipples 225 and corresponding recesses 237 are provided to securely attach the mounting mechanism 230 to the seat back 224 as described above. Chair frame 222 is secured directly to the mounting mechanism 230 via fasteners 244 which engage threaded openings 235 in mounting mechanism 230. This embodiment provides the advantage of requiring fewer parts than the embodiment illustrated in FIGS. 4 and 5.

Each of the embodiments described thus far permits substantial movement by the seat back relative to the adjacent frame pad 22 about three axes as shown in FIGS. 3A through 3C. One axis extends substantially perpendicularly through the mounting mechanism 30 and seat back 24 in a front-to-back direction through the chair 10. This axis is substantially parallel to the surface on which the chair 10 rests. A second axis extends substantially vertically through the mounting mechanism 30 and seat back 24 in a top to bottom direction and is substantially perpendicular to the surface on which the chair rests The third axis extends through the seat back 22 and mounting mechanism 30 in a left to right direction and is substantially parallel to the surface oil which the chair 10 rests.

Desirably, the seat back should meet substantially equal resistance from the resilient pad 31 while rotating about each axis A mounting mechanism 30 having a circular shape best facilitates this movement. The practice of the present invention includes using other shapes, however, other geometries may cause the seat back to have more resistance and, thus, less range of motion in at least one, and potentially more than one, direction.

The material selected for resilient pad 31 should provide for ease of movement and ready tiltability of the seat back. Desirably, the resilient pad 31 is constructed from a rubber or rubber-like material. Natural or synthetic rubbers may be used, but thermoplastic, thermoset, or composite materials may be used. The resilient material has a Shore hardness of between about 45 and about 100 and, preferably, about 85. Other ranges of hardness may be used depending on a number of factors including the size of the chair, the design of the chair, and the size and weight of the person the chair is intended to accommodate. It will be appreciated that selecting the material and Shore hardness for resilient pad 31 involves some amount of subjective determination of the appropriate "feel" desired for a particular chair.

Figure 7:
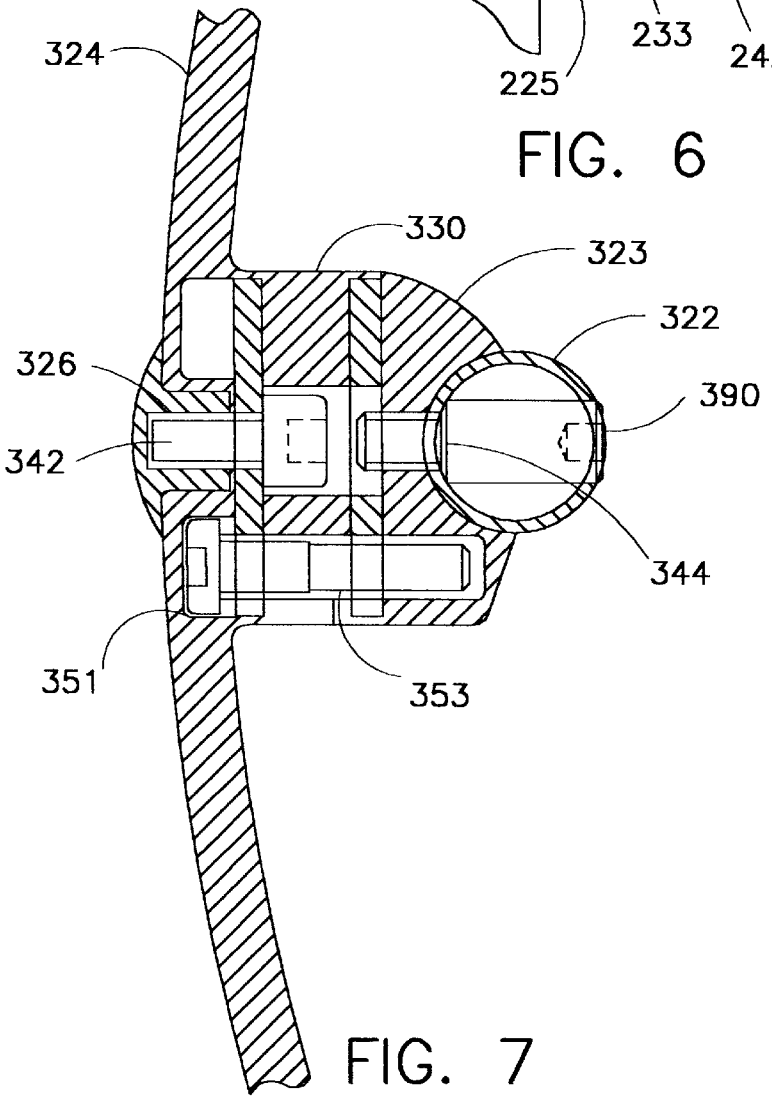
FIG. 7 is a vertical section taken through an alternative embodiment of the present invention showing the mounting of a chair seat back to an adjacent chair frame pad.
Figure 8:
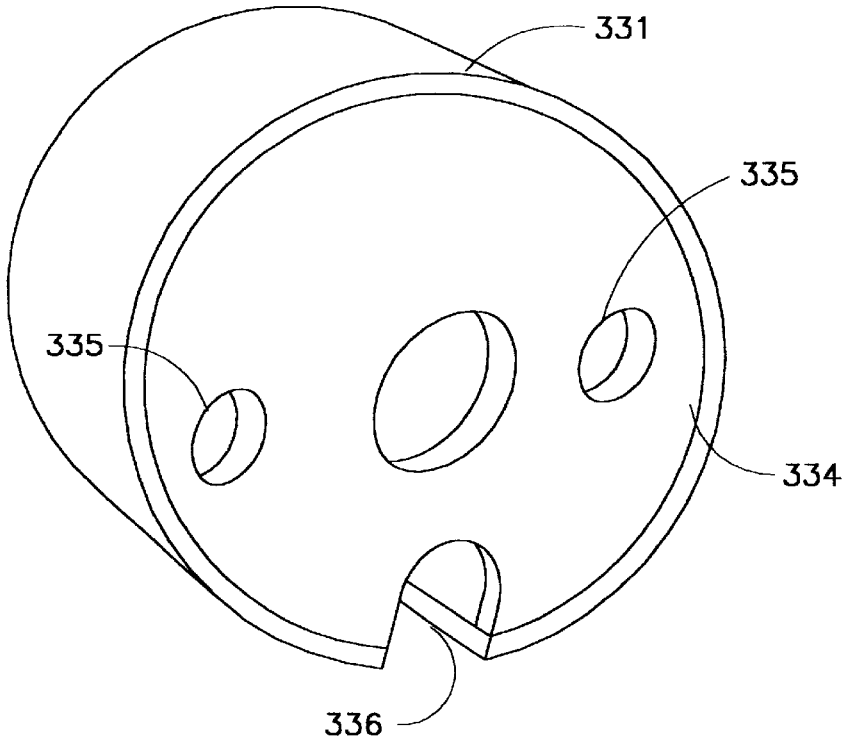
FIG. 8 is a front perspective view of the mounting mechanism of the present invention.
Figure 9:
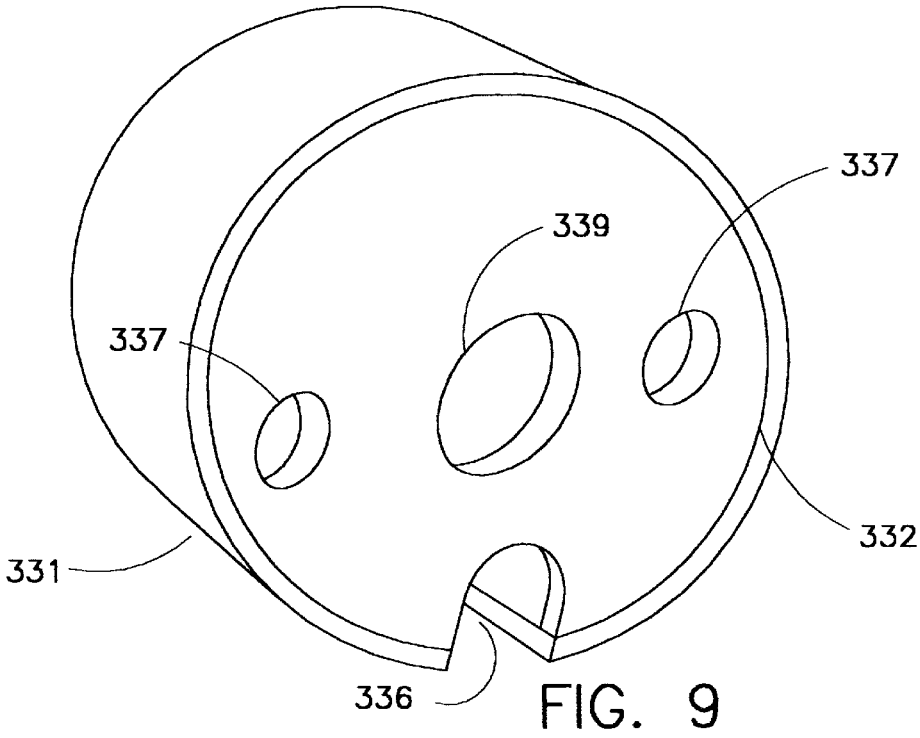
FIG. 9 is a rear perspective view of the mounting mechanism of the present invention.
Figure 10A:
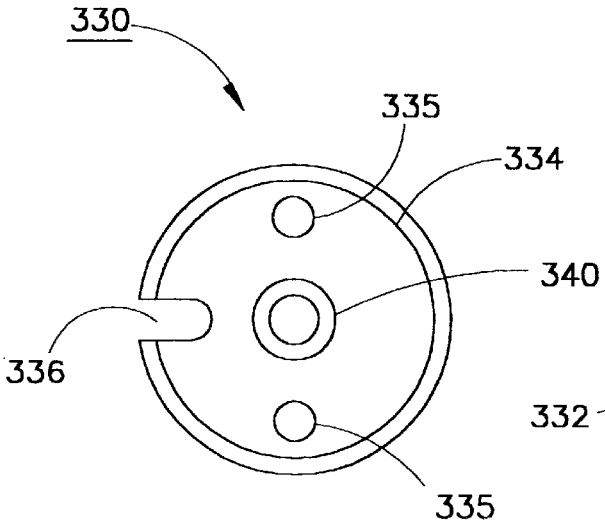
FIGS. 10A–10D are elevational and sectional views of the mounting mechanism of the present invention.
Figure 10C:
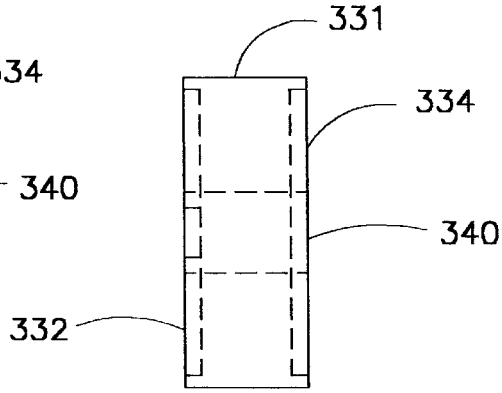
Figure 10B:
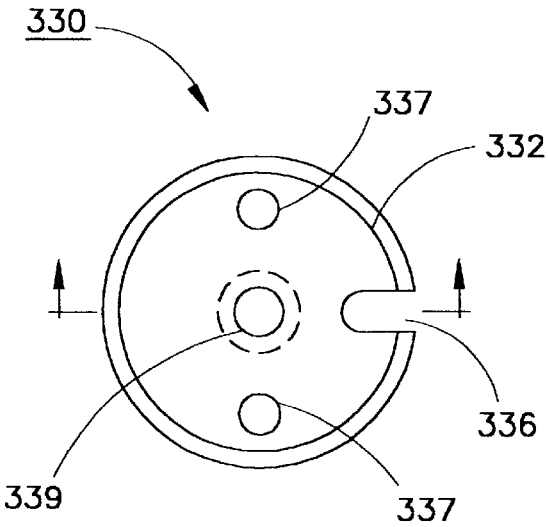
Figure 10D:
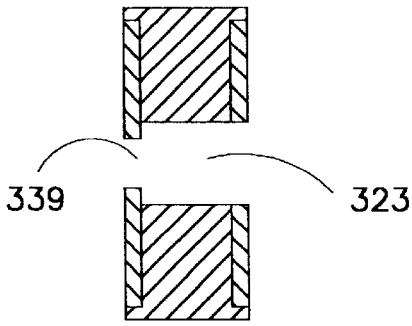

The embodiment depicted in FIG. 7 further illustrates the wide variety of implementations of the basic principles of the present invention. Seat back 324 is secured to mounting mechanism 330 by threaded knob 326 and fastener 342. The mounting mechanism 330 for this embodiment is depicted in FIGS. 8, 9, and 10A through 10D and includes a slot 336 which extends inwardly toward the center of mounting mechanism 330 from its peripheral edge. In this preferred embodiment, the slot 336 is U-shaped, although it may have some other shape. Desirably, the slot is positioned in the mounting mechanism 330 such that it faces downwardly towards the floor on which the chair 10 is resting but may alternatively be aligned to limit or control motion in other directions. Mounting mechanism 330 is comprised of first and second plates 332, 334 which are secured to, and desirably embedded in, resilient pad 331. As best seen in FIGS. 10C and 10D, when embedded, the outer surfaces of plates 332, 334 are substantially coplanar with the outside surface of the resilient pad 331. It will be appreciated that the diameter of the first and second plates 332, 334 is less than that of the resilient pad 331 such that a thin portion of the material making up resilient pad 331 extends beyond the diameter of the plates 332, 334. First plate 332 is intended to face the seat back 324 and is thus provided with recesses 337 for engagement with projecting nipples on the seat back 324. The first plate 332 further includes an opening 339 which shares a central axis with passage 333 in the resilient pad 331. The second plate 334 is intended to face the chair frame pad 322 and includes threaded openings 335 for engagement with fasteners that secure the mounting mechanism 330 to the chair frame pad 322. The second plate further includes an opening 340 which shares a central axis with the passage 333 through resilient pad 331. It will be readily appreciated that opening 340 is sized to be larger than opening 339 so as to accept the head of a fastener 342 passing therethrough.

Turning again to FIG. 7, the mounting mechanism 330 is secured to the chair frame 322 using a generally semi-circular shaped support pad 323 therebetween. The support pad 323 may be a separate component from chair frame 322 or may be formed integrally therewith. The support pad 323 is secured to the chair frame 322 with fastener 344. Additionally, a decorative cap 390 may be used with the frame 322 to hide the fastener 344. In this embodiment, the chair frame pad 322 is tubular, although it could be other shapes or could be solid. A travel stop 353 may be secured at one end thereof to the half round pad 323 and extended through the slot 336 in the mounting mechanism 330. The travel stop 353 has a first smaller diameter in the portion that extends through the slot 336 and a second larger diameter portion at the end opposite that secured to the support pad 323 that extends into a cavity 351 in the seat back 324. In a preferred embodiment, the travel stop 353 is provided with treads and threadedly engages the half round pad 323 in threaded opening 355. Although the term "diameter" has been used in describing the travel stop 353, it should be understood that the travel stop 353 may take on a variety of cross sectional shapes other than round. The only restriction is that it has a smaller-sized portion adapted to fit into slot 336 and a larger-sized portion that fits into cavity 351.

The arrangement described above limits movement of the seat back about one or more axes of rotation. As the person sitting in the chair leans back in the seat back, it will be appreciated that the first plate 332 will tilt with the seat back 324 so as to compress the upper portion of the resilient pad 331. Simultaneously, the lower portion of the resilient pad 331 will expand and the formerly parallel plates 332, 334 will take on a V-shaped relationship. As the lower portion of the first plate 332 moves away front the lower portion of the second plate 334, its travel will be checked by the large diameter portion of the travel stop 353, That is, file large diameter portion of the travel stop 353 will limit the movement of first plate 332 and, it follows seat back 324. It will be readily appreciated that the amount of backward tilt allowed will be determined by the length of that portion of the travel stop 353 that projects outwardly from the first plate 332.

Although the travel stop 353 has been illustrated as being secured to a portion of the chair frame, it will be readily appreciated that the stop may be secured to the seat back. In that case, a cavity or opening is provided in the chair frame to receive the large diameter portion of the travel stop 353.

Referring again to FIGS. 4 and 5, although the first and second plates 32, 34 are shown as being embedded in the resilient pad 31, in an alternative embodiment, the first and second plates 32, 34 could be the same diameter as that of the resilient pad 31; a "sandwich" embodiment. In this embodiment, the plates are not embedded in the resilient pad 31. Rather, the plates 32, 34 arc secured to the surface of the resilient pad 31 using, for example, an adhesive, the operation of which may be enhanced by roughening the surfaces of the plates 32, 34 that contact with resilient pad 31. This approach is not as desirable as the embedded approach because it is believed that the embedded approach makes the resilient count 30 easier to manufacture. Nevertheless, there may be particular chair designs wherein for functional or aesthetic reasons, the sandwich embodiment is preferred.

Figure 2:
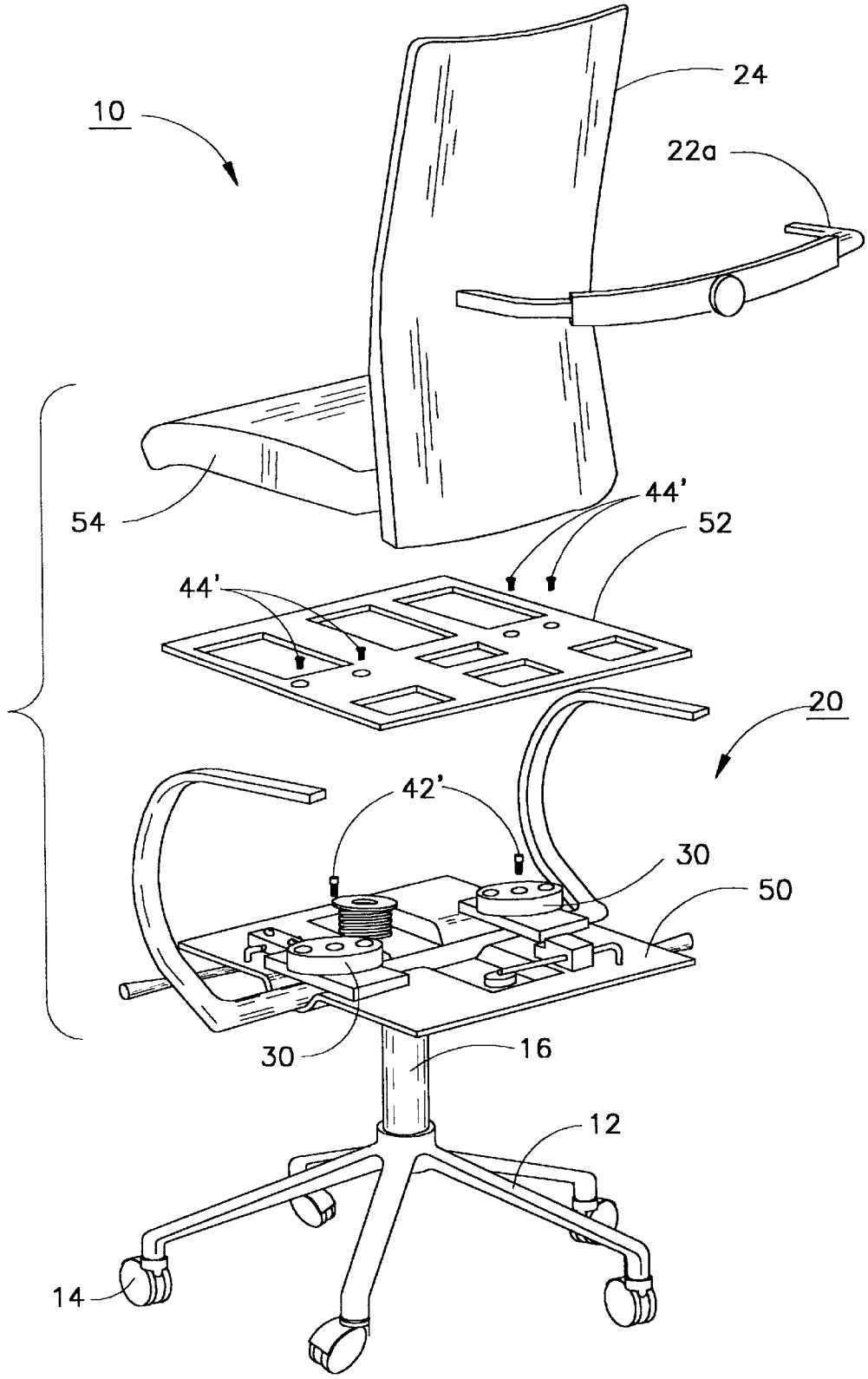
FIG. 2 is an exploded rear perspective view of the chair of FIG. 1.
Figure 2A:
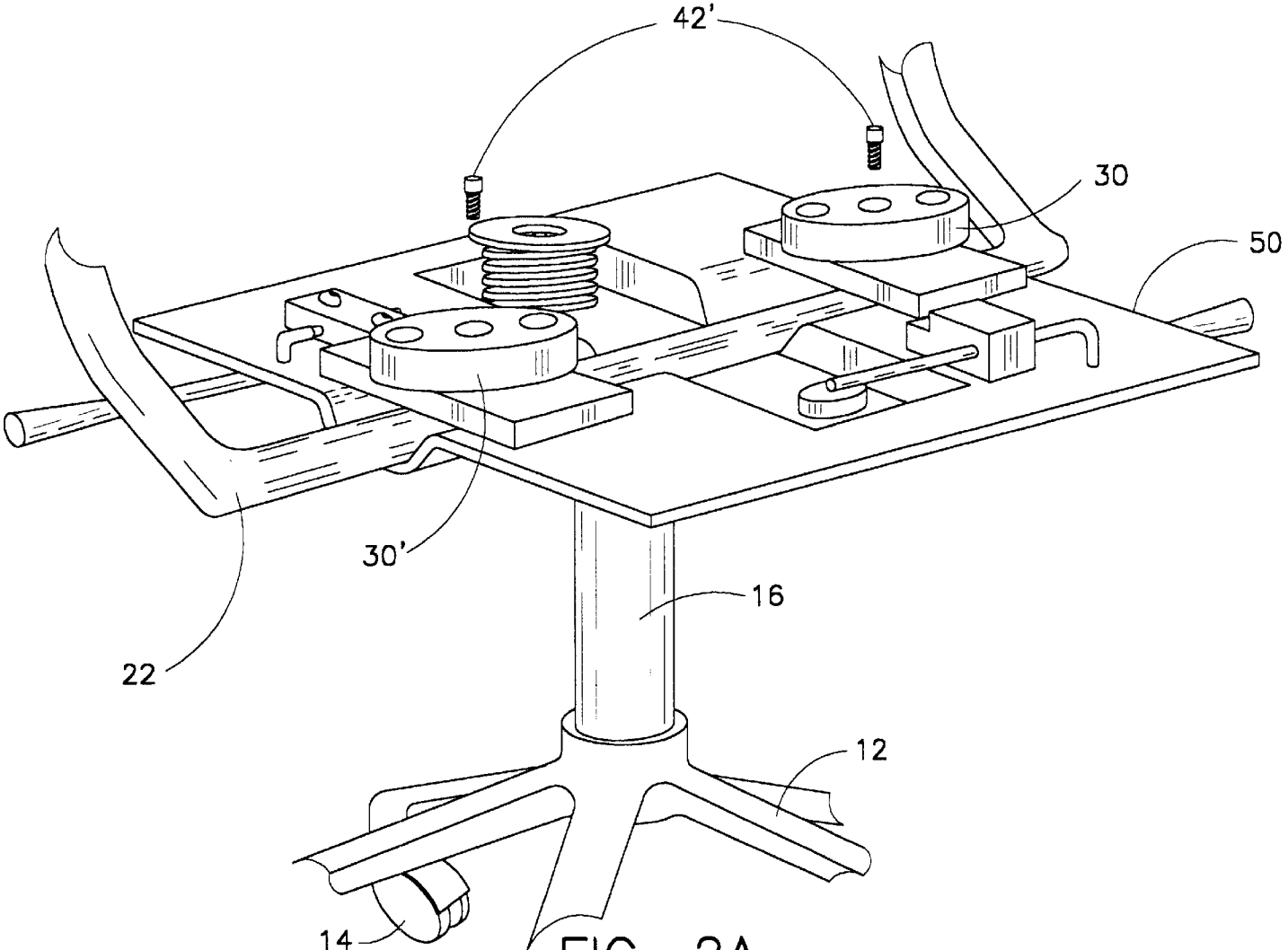
FIG. 2A is a top view of the fixed seat support.

Returning to FIGS. 1, 2, and 2A, seat support column 16 is rigidly attached to seat assembly 20. In the preferred embodiment, seat assembly 20 comprises a fixed seat support 50, mounting mechanisms 30, seat pan 52, and seat 54 attached to seat pan 52. At least one, and desirably two, mounting mechanisms 30' are connected to fixed seat support 50 with threaded fasteners 42'. Seat pan 52 is then connected to mounting mechanisms 30' with threaded fasteners 44'. It will be appreciated that when seat 54 is placed over or otherwise engagedly slid into place on seat pan 52, seat 54 will be pivotal in forward or backward directions, and from side to side to a limited degree. When seat pan 52 is attached to seat 54, independent movement of seat 54 with respect to seat back 24 is established. The mounting mechanisms 30' are the same as those described for connecting the seat back 24 to the frame 22, but because of ergonomic differences between seat backs and seats, the size, thickness, and Shore hardness of resilient pads 31 in mounting mechanisms 30' used for connecting the seat pan 52 to the fixed seat support 50 may be varied. It will also be appreciated that a single mounting mechanism 30' could be used, having variable size, shape, and thickness, thereby providing pivotal movement in at least two axes. These factors, of course, will depend on the specific application and the requirements of the chair user.

Figure 11A:
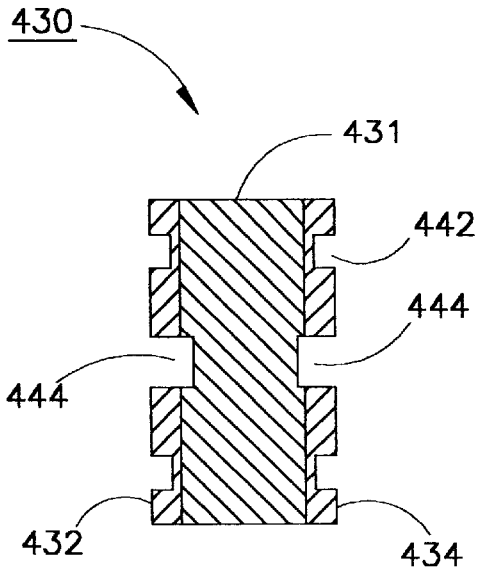
FIGS. 11A–11C are sectional views of alternative embodiments of the mounting mechanism of the present invention.
Figure 11C:
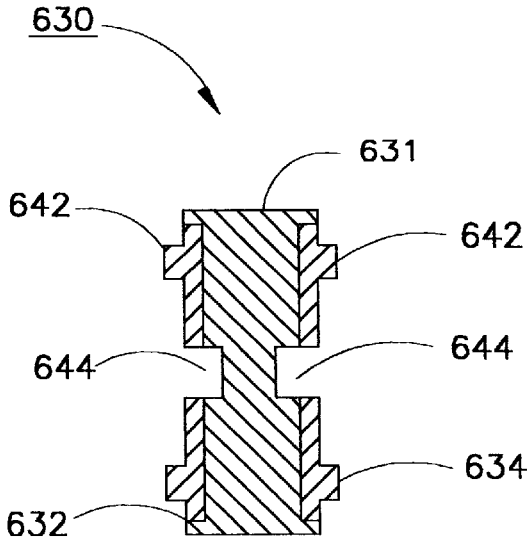
Figure 11B:
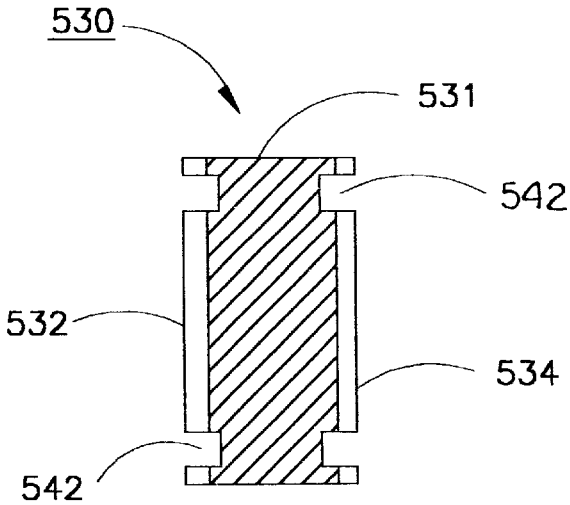

Although the mounting mechanism 30 of the present invention has been described thus far with respect to certain preferred embodiments, there are other approaches for constructing mounting mechanism 30. These alternative embodiments for the mounting mechanism are shown in FIGS. 11A through 11C. As shown in FIG. 11A, a sandwich embodiment mounting mechanism 430 includes a resilient pad 431 to which is secured on either side thereof a first plate 432 and a second plate 434. Although only one recess 442 is required, each of the plates 432, 434 includes at least one recess 442 positioned on either side of a threaded opening 444 that, desirably, is centered on the plate. Recesses 442 are adapted to receive a nipple (not shown) which projects outwardly from one of either the seat back or the adjacent chair frame. Although this alternative embodiment is depicted as having recesses 442 in both the first and second plates 432, 434, it will be readily appreciated that the recesses could be provided in only one of the plates. Although the recesses 442 and the accompanying nipples have been shown in this and other embodiments as having a circular shape, it will be readily appreciated that other shapes may be used as well. For example, rectangular or square nipples and recesses may be used depending on manufacturing considerations.

Referring now to FIG. 11B, an alternative sandwich embodiment of mounting mechanism 530 includes a resilient pad 531 to which is secured on either side thereof first and second plates 532, 534 respectively. Threaded openings 542 are provided in each of the plates and are adapted to receive fasteners (not shown) for securing the mounting mechanism 530 between the chair seat back and an adjacent frame. It will be readily appreciated that the two-fastener approach may be used with an embedded embodiment also. No central passageway 33 (See FIG. 10A) is required in this embodiment.

Turning now to FIG. 11C, an alternative embodiment of the mounting mechanism 630 includes a resilient pad 631 to which is secured on either side thereof first and second plates 632, 634 respectively. Each of the plates includes a threaded opening 644 and at least one, and preferably two, nipples 642 extending from the plates 632, 634 towards one of either the chair seat back or an adjacent frame pad. The resilient mount 630 is secured to the chair seat back and the adjacent frame using fasteners (not shown) which engage the threaded openings 644 in the plates 632, 634. This embodiment demonstrates that the nipples 642 may be provided on either the resilient mount 630 or on one of the chair seat back or the adjacent frame. It will be readily appreciated that nipples 642 may be provided on one or the other, or both of the first, or second plates 632, 634.

Given the wide number of chair designs in which the present invention may be incorporated, it may be desirable to combine various features of the embodiments discussed thus far. For example, the mounting mechanism 630 illustrated in FIG. 11B could be provided with one plate 632 having extending nipples and a second plate 634 configured with two threaded openings, such as the plate 534 illustrated in FIG. 11C. That is, the mounting mechanism of the present invention may be configured to be secured on one side with one fastener and to be secured on an opposing side with two fasteners. Alternatively, the mounting mechanism can be configured to include projecting nipples on one side and with threaded openings or recesses on an opposing side. Each of these variations employ the basic principles of the invention which include providing a resilient pad to which is secured on either side thereof a plate.

In yet another alternative embodiment of the present invention the angular relationship between the plates may be modified. In each of the embodiments discussed thus far the plates are illustrated as being substantially parallel. However, in an alternative embodiments the resilient pad may be configured to have a smaller width at one end as opposed to an opposing end with a result that the first and second plates will be angled towards each other when the chair seat back is at rest. The term "at rest" refers to the angular relationship between the first and second plates when the chair is unoccupied and also refers to the angular relationship to which the plates return after an occupant vacates the chair. It will be readily appreciated that the resistance to movement about at least one of the axes may vary somewhat in this embodiment. However, it is believed that acceptable performance will still be obtained.

The chair and mounting of the present invention offer numerous advantages over prior art chairs and mounts. These advantages include, but are not limited to, the fact that the resilient pad 31 is not constrained in any type of enclosed space or cup. Thus, the seat back 24 is free to move in an unlimited number of directions and the seat so as to take full advantage of the physical properties of the resilient pad 31. Thus, although some of the advantages of the present invention have been described herein above, it should be understood that additional advantages of the present invention will be readily ascertainable by those of ordinary skill in the art. The scope of the present invention includes those additional advantages.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims and their equivalents.

What we claim is:

1. A chair having a seat and a separate seat back comprising:

(a) a chair frame mounted to a pedestal support and having a pair of arms extending upwardly on each side of the seat and a substantially fixed rear segment that wraps around the seat back;

(b) a mounting mechanism movably connecting said seat back to said fixed rear segment;

(c) said mounting mechanism including:

i. first and second spaced apart plates, one of said plates secured to said fixed rear segment and the other to said seat back;

ii. a resilient pad positioned between and secured to said plates; and (d) wherein said seat back is capable of being pivoted about at least two axes of rotation, one of which is substantially perpendicular to the plane of said seat back.

2. The chair of claim 1 wherein said seat back is capable of being moved to a plurality of positions about at least three axes of rotation including one of which is substantially perpendicular to the plane of said seat back.

3. The chair of claim 1 wherein said seat back is integrally formed with a tall portion and a short portion, either of said tall portion and said short portion capable of being installed to extend upwardly when said seat back is connected to the mounting mechanism.

4. The chair of claim 1 wherein said resilient pad is formed from an elastomeric material having a Shore hardness of between about 45 and about 100.

5. The chair of claim 1 wherein said resilient pad is formed from an elastomeric material having a Shore hardness of between about 80 and about 90.

6. The chair of claim 1 wherein one of said seat back and said frame rear segment further includes at least one projecting nipple extending towards said resilient pad, said at least one projecting nipple being received in at least one recess formed in one of said first plate or said second plate that such movement of said seat back causes movement of said plate movably secured thereto.

7. The chair of claim 1 wherein one of said first plate and said second plate further includes at least one projecting nipple extending towards one of said seat back and said frame rear segment, said at least one projecting nipple being received in at least one recess formed in one of said seat back and said frame rear segment.

8. The chair of claim 1 wherein said first and second plates are embedded in said resilient pad such that outside surfaces of said plates are substantially coplanar with corresponding outside surfaces of said resilient pad.

9. The chair of claim 1 wherein said resilient pad is substantially circular in shape.

10. The chair of claim 1 wherein said resilient pad further includes a slot extending inwardly from a peripheral edge of said pad.

11. The chair of claim 10 further including a travel stop positioned in said slot and attached at one end thereof to said frame rear segment said travel stop having a small diameter portion positioned in said slot and a large diameter portion located at an end opposite that of said end attached to said frame rear segment and positioned in a cavity in said back seat and adjacent to said first plate.

12. The chair of claim 10 further including a travel stop positioned in said slot and attached at one end thereof to said seat back, said travel stop having a small diameter portion positioned in said slot and a large diameter portion located at an end opposite that of said end attached to said seat back and positioned in a cavity in said rear segment and adjacent to said second plate.

13. The chair of claim 1 wherein said resilient pad includes at least one passage therethrough adapted for receiving a fastener for movably securing said resilient pad to one of said seat back and said rear segment.

14. The chair of claim 1 wherein said chair frame further includes a fixed seat support and at least one mounting mechanism for connecting said seat to said fixed seat support, wherein said seat is capable of being pivoted about at least one axis of rotation.

15. A chair having a seat and separate seat back, said chair comprising:

(a) a chair frame mounted to a pedestal support and having a pair of arms extending upwardly on either side of the seat and a substantially fixed seat support;

(b) at least one mounting mechanism movably connecting said seat to said seat support, said at least one mounting mechanism including:

i. first and second spaced apart plates, one of said plates secured to said frame and the other to said seat;

ii. a resilient pad positioned between and secured to said plates; and (c) wherein said seat is capable of being moved to a plurality of positions about at least one axis of rotation.

16. The chair of claim 15 wherein sad resilient pad is formed from an elastomeric material having a Score hardness of between about 45 and about 100.

17. The chair of claim 15 wherein said resilient pad is formed from an elastomeric material having a Shore hardness of between about 80 and about 90.

18. The chair of claim 15 wherein said first and second plates are embedded in said resilient pad such that outside surfaces of said plates are substantially coplanar with corresponding outside surfaces of said resilient pad.

19. The chair of claim 15 wherein said resilient pad is substantially circular in shape.

20. The chair of claim 15 wherein said mounting mechanism includes at least one passage therethrough adapted for receiving a fastener for movably securing said at least one mounting mechanism to said seat support and seat.

21. The chair of claim 15 wherein said chair frame further includes a substantially fixed rear segment and a mounting mechanism connecting said seat back to said rear segment, wherein said seat back is capable of being pivoted about at least two axes of rotation, one of which is substantially perpendicular to the plane of the seat back.

22. A chair having a seat pan and a separate seat back comprising:

(a) a chair frame mounted to a pedestal support and having a pair of arms extending upwardly on each side of the seat and a substantially fixed rear segment that wraps around the seat back, and a substantially fixed seat support and a rear segment;

(b) a seat back mounting mechanism movably connecting said seat back to said fixed rear segment;

(c) said mounting mechanism including:

i. first and second spaced apart plates, one of said plates secured to said fixed rear segment and the other to said seat back;

ii. a resilient pad positioned between and secured to said plates;

iii. said resilient pad forming a sole connection between said seat back and said rear segment; and (d) wherein said seat back is capable of being pivotable about at least two axes of rotation, one of which is substantially perpendicular to the plane of said seat back;

(e) at least one seat mounting mechanism including:

i. first and second spaced apart plates, one of said plates secured to said frame and the other to said seat;

ii. a resilient pad positioned between and secured to said plates; and iii. said resilient pad forming the sole connection between said seat pan and said seat support.

(f) wherein said seat is capable of being moved to a plurality of positions about at least one axis of rotation.

* * * * *